US005944370A

United States Patent [19]

Ravet et al.

[11] Patent Number: 5,944,370

[45] Date of Patent: Aug. 31, 1999

[54] STRAP TOWING SYSTEM

[75] Inventors: Jeffrey A. Ravet, Ellensburg, Wash.; Richard L. Carter, Tempe, Ariz.

[73] Assignee: Anderson Hay & Grain Co., Inc., Ellensburg, Wash.

[21] Appl. No.: 09/170,875

[22] Filed: Oct. 13, 1998

Related U.S. Application Data

[60] Continuation of application No. 08/939,509, Sep. 29, 1997, abandoned, which is a division of application No. 08/723,625, Oct. 2, 1996, Pat. No. 5,725,089.

[51] Int. Cl.[6] ..... B65D 71/00; B66C 1/12

[52] U.S. Cl. ..... 294/74; 206/83.5; 206/597

[58] Field of Search ..... 294/74, 77, 149, 294/150, 67.41, 68.3; 280/19; 206/83.5, 442, 497, 595, 597, 598; 53/441, 443, 447, 134.1

[56] References Cited

U.S. PATENT DOCUMENTS

| | | | |
|---|---|---|---|
| 281,490 | 7/1883 | Grader . | |
| 1,462,897 | 7/1923 | Barto | 294/74 |
| 2,687,321 | 8/1954 | Toffolon | 294/74 |
| 3,547,457 | 12/1970 | Langer | 206/597 |
| 3,701,559 | 10/1972 | Marino et al. | 294/74 |
| 3,788,462 | 1/1974 | Meincer . | |
| 3,914,918 | 10/1975 | Laird . | |
| 3,945,493 | 3/1976 | Cardinal . | |
| 4,036,364 | 7/1977 | Ambrose . | |
| 4,127,223 | 11/1978 | Uchin | 294/150 |
| 4,320,701 | 3/1982 | Donaldson . | |
| 4,332,326 | 6/1982 | Kelly et al. . | |
| 4,538,385 | 9/1985 | Kandarian . | |
| 4,737,069 | 4/1988 | Coblentz | 294/74 |
| 4,781,473 | 11/1988 | LaFleur . | |
| 4,834,439 | 5/1989 | Van De Kamp | 294/74 |
| 4,963,037 | 10/1990 | Manerba . | |
| 5,111,931 | 5/1992 | Gombos et al. . | |
| 5,238,104 | 8/1993 | Gombos et al. . | |
| 5,386,905 | 2/1995 | Porter . | |
| 5,665,409 | 9/1997 | Drewry | 294/74 |

FOREIGN PATENT DOCUMENTS

| | | | |
|---|---|---|---|
| 12269 | 5/1932 | Australia | 206/83.5 |
| 194-072 | 9/1986 | European Pat. Off. . | |
| 2436-741 | 5/1980 | France | 294/74 |
| 2208641 | 4/1989 | United Kingdom | 294/74 |

*Primary Examiner*—Dean J. Kramer
*Attorney, Agent, or Firm*—Christensen O'Connor Johnson & Kindness PLLC

[57] ABSTRACT

The towing strap (18) for a unit of cargo (10) is wrapped around the lower portion of the unit. The towing strap (18) is cinched to the unit (10) with a standard friction buckle (22). The strap contains two forwardly extending loops (24, 26) positioned adjacent the forward edges (28, 30) of the unit of cargo (10). A towing line (36) may be hooked to the loops (24, 26) for towing the unit of cargo (10) over the ground.

11 Claims, 1 Drawing Sheet

Fig. 1.
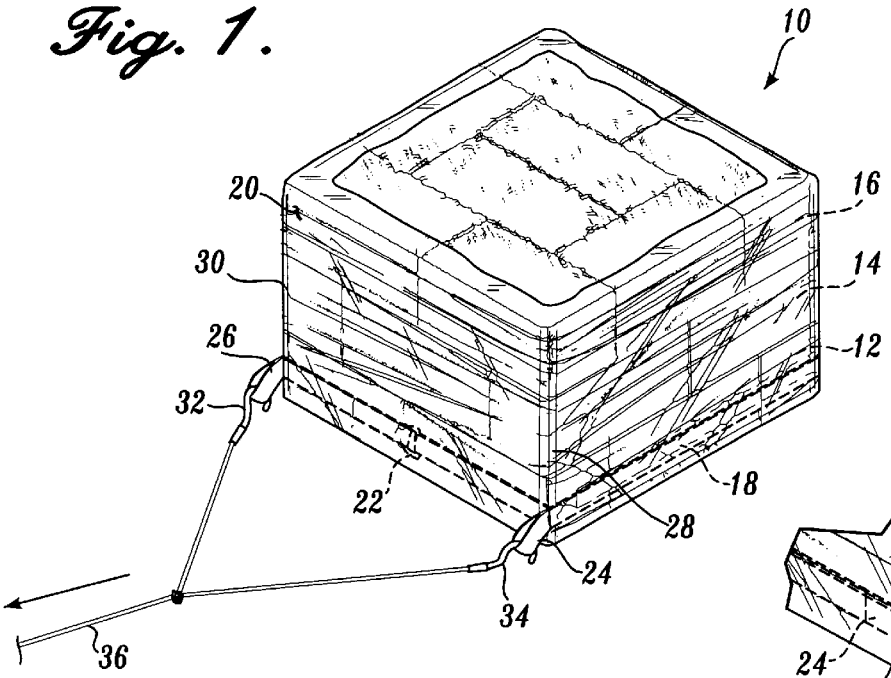
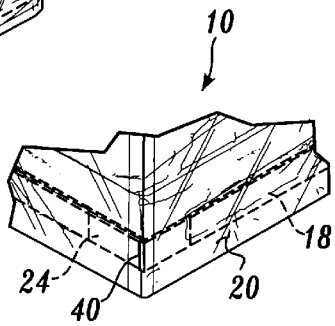
Fig. 4.
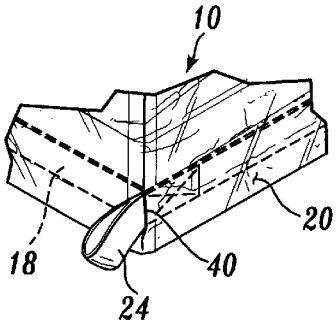
Fig. 5.
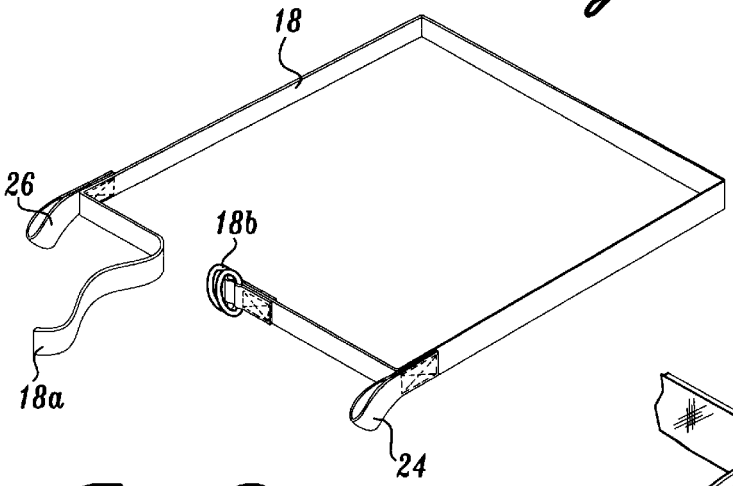
Fig. 2.
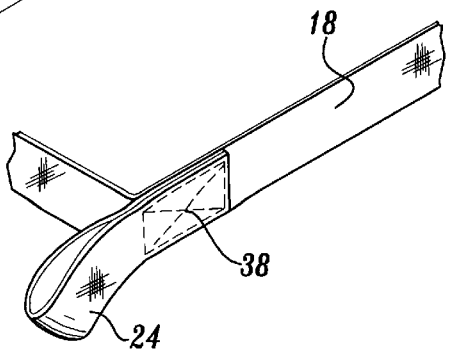
Fig. 3.

STRAP TOWING SYSTEM

This application is a continuation of U.S. patent application Ser. No. 08/939,509, filed Sep. 29, 1997 now abandoned, which is a divisional of U.S. patent application Ser. No. 08/723,625, filed Oct. 2, 1996, now U.S. patent No. 5,725,089, issued Mar. 10, 1998.

FIELD OF THE INVENTION

The present invention relates to a means for moving cargo and more particularly to an integral towing means for a unit of cargo.

BACKGROUND OF THE INVENTION

Transoceanic cargo is normally shipped in large containers that are placed in the hold or on the deck of a ship. Many times the cargo is subdivided into smaller units for ease of handling including placement in, and removal from, a container. Heavy cargo is normally handled with forklifts. However, when units of cargo are positioned near the far end of a container, it is sometimes difficult to move with a forklift. Therefore, some means for pulling the unit of cargo out of the container is necessary. One such towing device is disclosed in U.S. Pat. No. 5,238,104.

The unit of cargo disclosed in that patent comprises a plurality of hay bales stacked in a plurality of layers. A pair of cables are laid between two of the layers. The cables have loops at both ends. A board is placed through the loops on one end and snugged against the rear face of the cargo unit. The other loops extend outwardly from the opposite side of the unit of cargo. The free loops can be coupled to a towing strap, which, in turn, can be coupled to a towing vehicle. In this manner, the units of cargo can be removed from the container without attaching auxiliary towing devices to the units. The towing device illustrated in the '104 patent is cumbersome and labor-intensive to install. Moreover the device is made from relatively expensive materials.

SUMMARY OF THE INVENTION

The present invention provides a relatively inexpensive towing device that is easily and quickly applied to a unit of cargo. The binding means comprises a strap surrounding the unit of cargo and having a buckle means for cinching the strap tight about the unit of cargo. The strap includes a pair of loops affixed thereto at a predetermined spacing so that when cinched about a unit of cargo the loops are positioned adjacent to adjacent vertical edges of the unit of cargo.

In a preferred embodiment, the towing means is employed with a unit of cargo comprising multiple bales of materials such as hay. The plurality of bales are arranged in at least a first layer of multiple rows so that the bales define a stack with vertical peripheral sides. The towing strap surrounds at least the first layer of bales, engaging the vertical sides of the layer. The loops affixed to the strap are positioned adjacent vertical comers of the front face of the stack. In the preferred embodiment, binding means are also employed to hold the bales together as a unit. The binding means comprises an elongated sheet of a polymeric film that is stretched and wrapped in multiple layers about the vertical peripheral sides of the stack of bales. The film binds bales together as a cargo unit. A slot is cut in the film so that the towing loops can be exposed.

BRIEF DESCRIPTION OF THE DRAWINGS

A better understanding of the present invention can be derived by reading the ensuing specification in conjunction with the accompanying drawings wherein:

FIG. 1 is a perspective view of a unit of cargo showing the towing strap constructed and applied in accordance with the present invention;

FIG. 2 is a perspective view of the towing strap before installation;

FIG. 3 is an enlarged perspective view showing one of the towing loops forming part of the present invention;

FIG. 4 is a perspective view of one comer of a unit of cargo prior to pulling the towing loop from the film in which the unit is wrapped; and FIG. 5 is similar to FIG. 4 showing the towing loop freed from behind the film.

DETAILED DESCRIPTION OF THE PREFERRED EMBODIMENT

Referring first to FIG. 1, a unit of cargo 10 comprises, for example, three layers of 12, 14 and 16 of material such as bales of hay. A towing strap 18 constructed in accordance with the invention is cinched around the lower layer 12 of bales. The entire unit 10 is held together with a plurality of wraps of stretch wrap material comprising, for example, a polymeric film comprising polyethylene. The polyethylene film is stretched and wrapped about the units so that the upper edges and lower edges of the film shrink wrap overlap the upper and lower boundaries of the unit. The towing strap 18 is cinched about the lower layer using a conventional dual ring friction buckle 22. A pair of loops 24 and 26 are affixed to the towing strap 18 adjacent the forward edges 28 and 30 of the unit 10. The loops extend forwardly through openings cut in the stretch wrap 20. A pair of tow hooks 32 and 34 can then be inserted through the loops and a tow line 36 attached so that the entire unit 10 can be pulled by exerting a force in the direction of the arrow on the forward end of the tow line 36.

Referring to FIG. 2, the towing strap 18 comprises a rectangular loop that is sized to fit about the bottom layer of a unit of cargo. A free end 18*a* is then inserted through the conventional dual ring friction buckle 18*b* in a conventional manner. The free end 18*a* is then pulled to tighten the towing strap 18 about the unit of cargo. The strap only need be tight enough to hold its position about half-way up the first layer while the stretch wrap is being applied. The loops 24 and 26 are positioned so that when the strap is in place they will be adjacent the forward edges of the unit of cargo.

Referring to FIG. 3, one of the loops 24 is shown attached to the towing strap 18. Conventional cross-stitching 38 secures the ends of the loops 24, 26 to the portion of the towing strap 18 extending backwardly from the front face of the unit of cargo. In this way, the stitching is loaded in shear; thus it is able to withstand the force applied by a towing cable affixed to the loop 24. The strapping preferably employed is standard nylon fabric belting conventionally available throughout industry.

Referring to FIG. 4, after the stretch wrap 20 has been applied to the unit of cargo 10, the strap 18 and the loops (only loop 24 is shown in this figure) are covered by the stretch wrap. In order to free the loop for use, a slit is made in the stretch wrap along the dotted line 40 shown in FIG. 4. An operator can reach inside the slit 40 and pull the loop 24 free for use.

Because the towing strap of the present invention can be manufactured from conventionally available materials with only a small amount of labor added to sew the loops on at the appropriate spaced locations, tow straps constructed in accordance with the present invention can be made for one-third to one-fourth the cost of prior art towing means. The invention has been disclosed in connection with a preferred embodiment. One of ordinary skill after reviewing the foregoing specification will be able to make various alterations and changes thereto without departing from the spirit and scope of the invention. It is therefore intended that the Letters of Patent granted hereon be limited only by the definition contained in the appended claims and equivalents thereof.

The embodiments of the invention in which an exclusive property or privilege is claimed are defined as follow:

1. A unit of cargo including a towing strap, said unit of cargo having a perimeter defined by a forward vertical face, a rearward vertical face, and vertical sides, said strap being sized to circumscribe said perimeter, said towing strap having a buckle on an end thereof and an opposite free end, said strap having a pair of loops attached thereto, said loops attached to said strap at predetermined spaced locations so that when said strap is cinched about the perimeter of said unit of cargo, the loops are positioned adjacent the vertical edges of said forward face and extend from said strap in a plane that is substantially parallel to a plane extending normally to said forward vertical face, wherein said unit of cargo further comprises at least a first layer of stretch wrap disposed around said perimeter of said unit of cargo, said stretch wrap being capable of having first and second slits formed therein, said slits being sized to receive said loops therethrough.

2. The unit of cargo of claim 1, wherein said strap further comprising fabric strapping.

3. The unit of cargo of claim 2, wherein each said loop comprises a segment of fabric strapping, said segment forming a loop by folding said segment back on itself, the ends of said loop being fastened to said towing strap at predetermined locations.

4. The unit of cargo of claim 3, wherein the ends of said loops extend rearwardly along opposite vertical sides of said unit when said towing strap is in place on said unit.

5. A method of unitizing a unit of cargo for towing, said unit of cargo having a perimeter defined by a forward vertical face, a rearward vertical face, and vertical sides, the method comprising the steps of:

(a) cinching a strap around the perimeter of said unit of cargo to circumscribe the perimeter;

(b) positioning a pair of loops on said strap such that when said strap is cinched around said perimeter of said unit of cargo, said loops are positioned adjacent the vertical edges of said forward face and extend from said strap in a plane that is substantially parallel to a plane extending normally to said forward vertical face; and (c) wrapping said unit of cargo with at least a first layer of stretch wrap to hold said unit of cargo together.

6. The method of unitizing a unit of cargo for towing of claim 5, further comprising the step of forming first and second slits in said stretch wrap, said slits being sized to receive said loops therethrough.

7. The method of unitizing a unit of cargo for towing of claim 6, wherein each said loop comprises a segment of fabric strapping, said segment forming a loop by folding said segment back on itself, the ends of said loop being fastened to said towing strap at predetermined locations.

8. A unit of cargo including a towing strap, said unit of cargo having a perimeter defined by a forward vertical face, a rearward vertical face, and vertical sides, said strap being sized to circumscribe said perimeter, said towing strap having a buckle on an end thereof and an opposite free end, said strap having a pair of loops attached thereto, said loops attached to said strap at predetermined spaced locations so that when said strap is cinched about the perimeter of said unit of cargo, the loops are positioned adjacent the vertical edges of said forward face, wherein said unit of cargo further comprises at least a first layer of stretch wrap disposed around said perimeter of said unit of cargo, said stretch wrap being capable of having first and second slits formed therein, said slits being sized to receive said loops therethrough, wherein said strap further comprising fabric strapping, wherein each said loop comprises a segment of fabric strapping, said segment forming a loop by folding said segment back on itself, the ends of said loop being fastened to said towing strap at predetermined locations.

9. The unit of cargo of claim 8, wherein the ends of said loops extend rearwardly along opposite vertical sides of said unit when said towing strap is in place on said unit.

10. A method of unitizing a unit of cargo for towing, said unit of cargo having a perimeter defined by a forward vertical face, a rearward vertical face, and vertical sides, the method comprising the steps of:

(a) cinching a strap around the perimeter of said unit of cargo to circumscribe the perimeter;

(b) positioning a pair of loops on said strap such that when said strap is cinched around said perimeter of said unit of cargo, said loops are positioned adjacent the vertical edges of said forward face;

(c) wrapping said unit of cargo with at least a first layer of stretch wrap to hold said unit of cargo together; and (d) forming first and second slits in said stretch wrap, said slits being sized to receive said loops therethrough.

11. The method of unitizing a unit of cargo for towing of claim 10, wherein each said loop comprises a segment of fabric strapping, said segment forming a loop by folding said segment back on itself, the ends of said loop being fastened to of said towing strap at predetermined locations.

* * * * *